US005267426A

United States Patent [19]

Davis

[11] Patent Number: 5,267,426

[45] Date of Patent: Dec. 7, 1993

[54] PRODUCT LOADING SYSTEM

[76] Inventor: Robert Davis, Unit #519, 7305 Woodbine Avenue, Markham, Ontario, Canada, L3R 3V7

[21] Appl. No.: 888,017

[22] Filed: May 26, 1992

[51] Int. Cl.[5] ..... B65B 35/54; B65B 39/06; B65B 43/26

[52] U.S. Cl. ..... 53/154; 53/168; 53/171; 53/247; 53/531; 53/572

[58] Field of Search ..... 53/154, 168, 171, 202, 53/237, 247, 531, 572, 260

[56] References Cited

U.S. PATENT DOCUMENTS 2,721,015 10/1955 Canales ..... 53/572
3,537,230 11/1970 Dorfman ..... 53/168
3,698,153 10/1972 Lieberman ..... 53/572 X
3,815,321 6/1974 Hartman ..... 53/531 X
4,179,865 12/1979 Pellaton ..... 53/531 X
4,524,566 6/1985 Hauers et al. ..... 53/168 X
4,539,795 9/1985 Wilkinson ..... 53/202 X
4,781,011 11/1988 Prakken ..... 53/202 X
4,989,391 2/1991 Wetter ..... 53/572 X

*Primary Examiner*—John Sipos
*Assistant Examiner*—Linda Johnson

[57] ABSTRACT

A system for loading product into a container comprises a conveyor with side by side staggered delivery portions, a pair of side by side bottom opening receptacles fed at different times by the deliver portions of the conveyor, a hopper moveable in an alternating manner to a product receiving position beneath each of the receptacles and a container holder below and fed by the hopper.

4 Claims, 6 Drawing Sheets

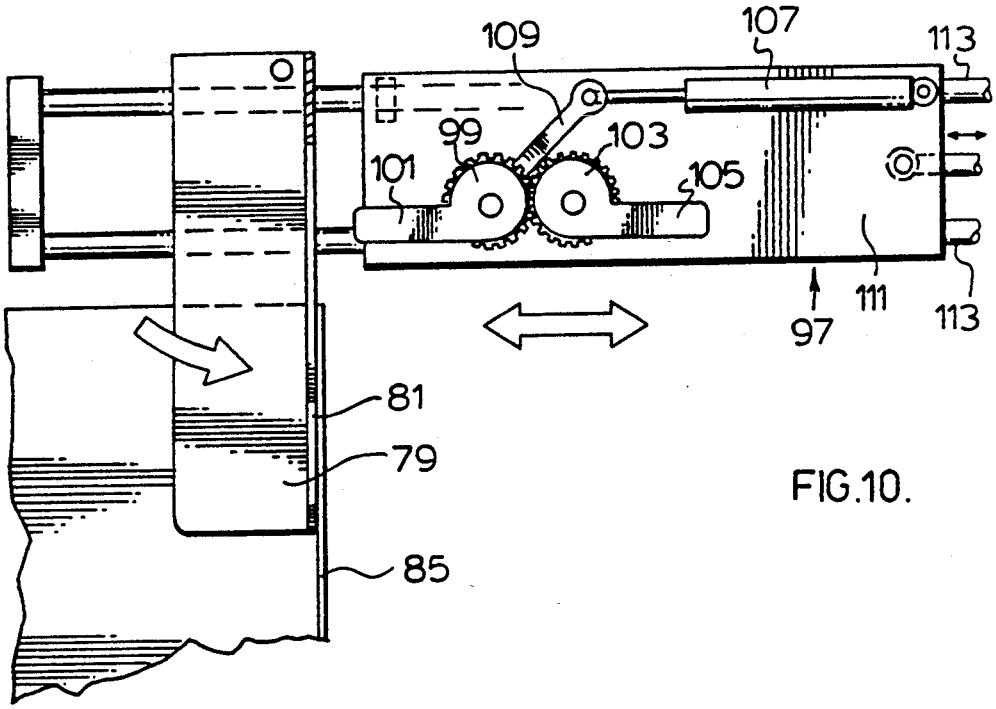
FIG.10.
FIG.11.
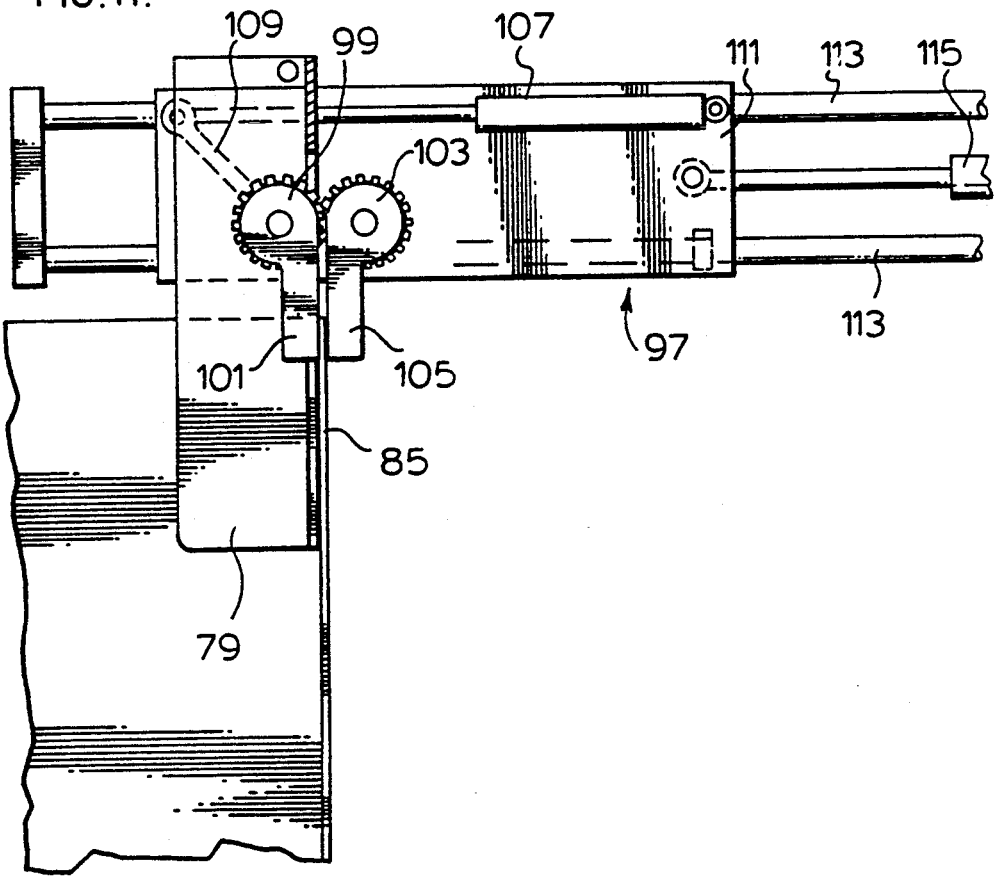

PRODUCT LOADING SYSTEM

FIELD OF THE INVENTION

The present invention relates to a high speed product loading system.

BACKGROUND OF THE INVENTION

In today's economy, speed and efficiency of operation are a requirement for substantially all manufacturing and shipping operations. Product loading into a container for the product is no exception. One particular product loading system that requires high speed, efficient operation is the loading of individual milk pouches into containment bags for the pouches. Milk is always in high demand and, in order to meet that demand, loading machinery should be capable of extremely high speed loading, e.g. in excess of one hundred pouches per minute into the bags. This can only be accomplished with special machinery capable of the high speed operation with little or no down time of the machinery.

SUMMARY OF THE INVENTION

A system for loading product into a container comprises a conveyor with side by side staggered delivery portions, a pair of side by side bottom opening receptacles fed at alternating times by the delivery portions of the conveyor, a hopper moveable in an alternating manner to a product receiving position beneath each receptacle and a container holder below and fed by the hopper.

The key to the present invention is the use of the moveable hopper which is able to feed from the two receptacles to a single container holder which meets the high demand requirements and which is extremely efficient in its operation.

BRIEF DESCRIPTION OF THE

The above, as well as advantages and features of the present invention, will be described in greater detail according to the preferred embodiments of the present invention in which FIG. 1 is a perspective view of a product loading system according to a preferred embodiment of the present invention.

FIG. 10 is a side view of a bag gripper used to pull the loaded bag from the container holder of FIG. 1.

FIG. 11 is a view similar to FIG. 10 showing the bag gripper in its operative position.

DETAILED DESCRIPTION OF THE PREFERRED EMBODIMENTS OF THE PRESENT INVENTION

Before going into the Figures in detail, it is to be noted that the description below relates to the packaging of milk pouches. However, the invention is not so limited and can be used for packaging of substantially any type of bagged or unbagged product.

Figure 1:
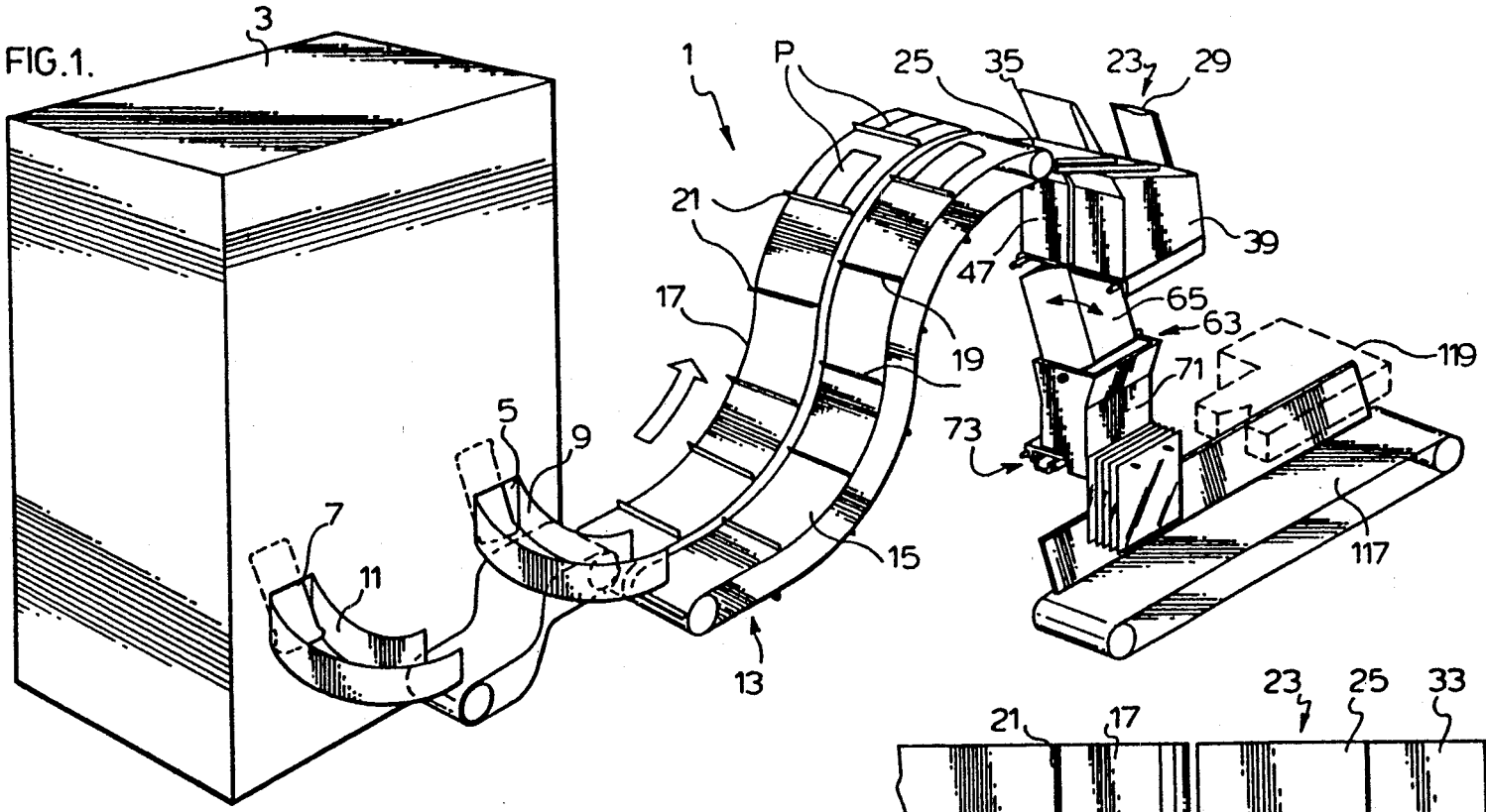

FIG. 1 shows a loading system generally indicated at 1. This loading system includes a milk pouch filler and sealer 3 where milk pouches are prepared to pass through a conveyor generally indicated at 13.

More specifically, the filler and sealer housing includes a pair of openings 5 and 7 which feed chutes 9 and 11 respectively. These chutes in turn feed to the conveyor 13 which is divided into side by side conveyor portions 15 and 17. Conveyor portion 15 includes upstanding product dividers 19 while conveyor portion 17 includes similar dividers 21.

A very important feature of the present invention is the offsetting or staggering of the dividers 19 relative to the dividers 21, i.e. dividers 19 are located midway of the span between dividers 21 and vice versa. This ensures that the two delivery portions which move upwardly toward a bag receptacle region generally indicated at 23 do not feed that region simultaneously but rather feed at different timed intervals relative to one another. FIG. 1 shows the milk pouch product generally indicated at P loaded on to the two portions of the conveyor and ready for delivery to receptacle region 23.

The receptacle region itself comprises a pair of side by side boxes 39 and 47. Box 39 is divided into a plurality of in-line individual receptacle compartments 41, 43 and 45 and box 47 is divided into in line receptacle compartments 49, 51 and 53 seen in FIG. 5 of the drawings.

Figure 2:
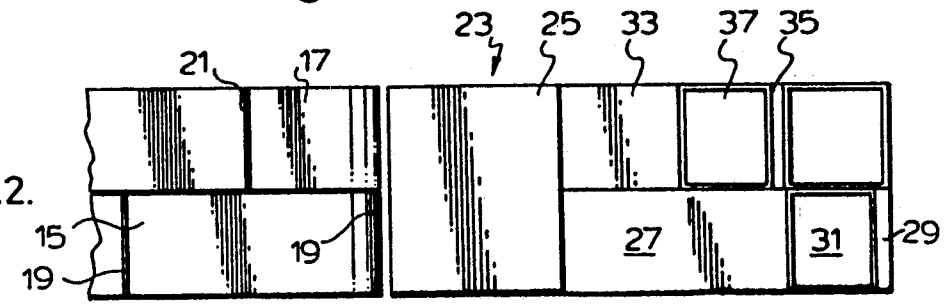
FIG. 2 is a top view of the receptacle set region of the system of FIG. 1.
Figure 3:
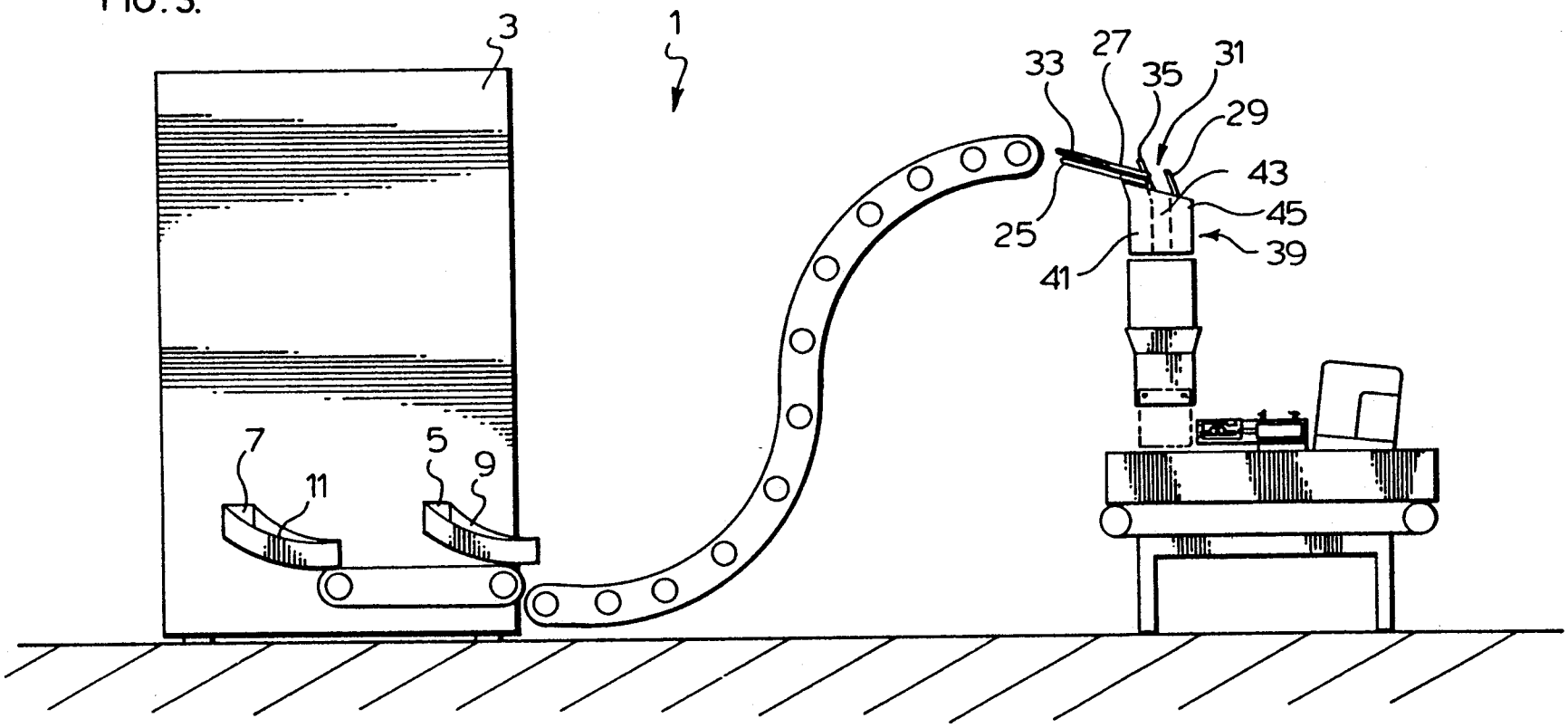
FIG. 3 is a side view of the system shown in FIG. 1.
Figure 4:
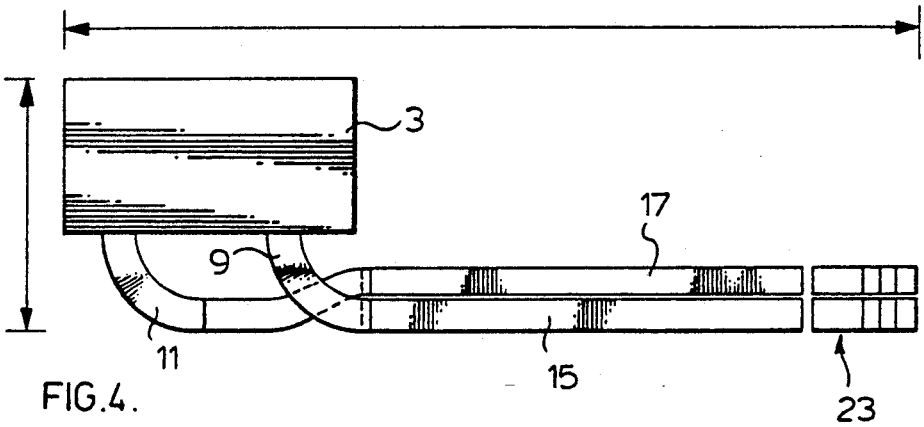
FIG. 4 is a top view of the system shown in FIG. 1.

Returning to FIGS. 1 and 2, a fixed plate 25 is provided at the forward end of the receptacle region onto which the milk pouches are initially pushed from the conveyor. Again, the pouches from the two conveyor portions are not located in this position simultaneously with one another but rather in an alternating fashion at an extremely rapid speed.

A pair of slide members are located directly in line with each of the conveyor portions 19 and 21. The slide members are identical in construction but, again, are moved out of synchronization with one another according to how the bags are delivered to plate 25.

The slide member associated with conveyor portion 15 comprises a plate 27, an upright blocker 29 and an opening 31 through the plate 27 adjacent blocker 29. The slide member associated with conveyor portion 17 includes a sliding plate 33, an upright blocker 35 and an opening 37 through the plate 33 adjacent blocker 35.

The two slide plates 27 and 33 move across the top of boxes 39 and 47 respectively. The opening 31 through slide plate 27 aligns in a sequenced order with the individual compartments 45, 43 and 41 of box 39. The opening 37 through plate 33 aligns with compartments 53, 51 and 49 provided in box 47.

Milk pouches carried by conveyor portion 15 are moved up to plate 25 and effectively loaded onto plate 27. Blocker 29 provides an end stop to ensure that the pouches do not go completely off of plate 27 and to further ensure that they are guided to plate opening 31. This plate opening 31, as earlier described, will first align with receptacle compartment 41 and the milk pouch will be dropped into that particular compartment. The next milk pouch is forced onto plate 27 as far as blocker 29 with the slide plate now having moved so that plate opening 31 aligns with compartment 43 and the milk pouch is dropped into that particular compartment. The next milk pouch is slid onto plate 27 where the plate opening now aligns with compartment 45 and blocker 29 ensures that the milk pouch is dropped into that particular compartment.

The identical procedure occurs with respect to plate 33 with the exception that the milk pouches delivered by this plate to the receptacle compartments are in effect one full bag behind the delivery sequence at plate 27. This is best explained having reference to FIG. 5 of the drawings which shows each of the receptacle compartments 41, 43 and 45 being loaded with product P, while receptacle compartment 53 and 51 of box 47 are loaded but compartment 49 remains unloaded with the next pouch or product P ready to drop down into compartment 49.

Each of the receptacle boxes includes a lower trap door. In particular, trap door 55 is pivotally mounted on post 57 beneath receptacle box 39 and trap door 59 pivotally mounted on post 61 below receptacle box 47. These trap doors remain in their up package holding positions until each of the in line receptacles has been filled. A sensing device which senses that all of the receptacles in the box has been filled then lowers the trap door beneath that particular box as shown beneath receptacle box 39 in FIG. 5. Note that the other receptacle box 47 has not been completely filled and trap door 59 remains in its up position.

Provided beneath the two receptacle boxes is a hopper arrangement generally indicated at 63. This hopper arrangement includes an upper hopper portion 65 which is pivotally mounted at 67 to move back and forth between the two receptacle boxes. The time of movement for the upper hopper portion is such that it pivots to a position directly beneath the receptacle box that has been completely filled so the upper hopper portion is positioned to receive the packages from the receptacle box. Again, it is to be noted that the other receptacle box remains closed at its bottom end through its associated trap door.

Movement of upper hopper portion 65 is controlled through a piston 69 which responds to the sensor that determines when the receptacle boxes have been filled.

Provided below hopper portion 65 is a lower hopper portion or chute 71. This hopper portion is fixed in its position and feeds downwardly to a container holder generally indicated at 73. In this case, the container holder is a bag support which holds a plurality of bags for receiving the milk pouches dropped through the lower hopper portion 71.

Bag holder 73 is similar to the bag holder in my U.S. Pat. No. 4,798,042, issued Jan. 17th, 1989. However, for clarity purposes, I will again describe that bag holder in detail.

Figure 5:
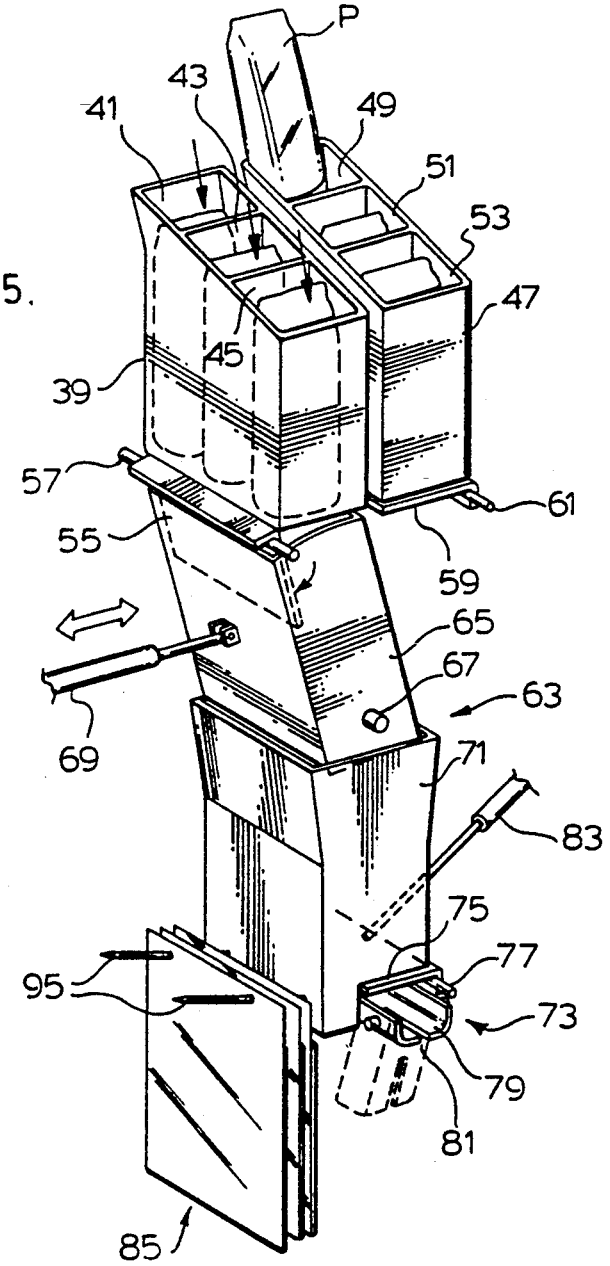
FIG. 5 is an enlarged perspective view of the receptacle set and container holder region of FIG. 1.
Figure 6:
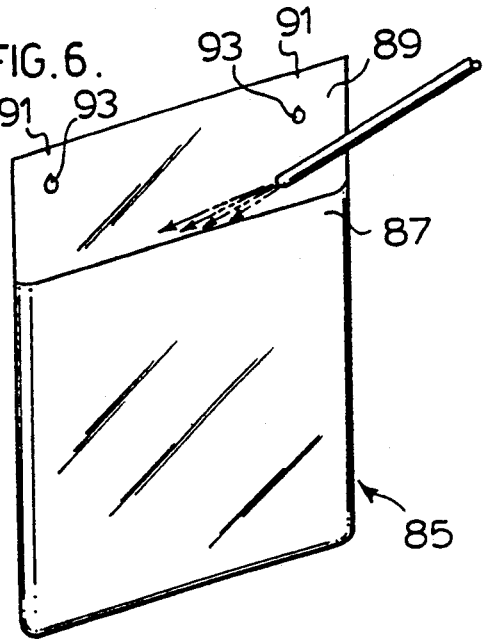
FIG. 6 is a perspective view of a bag from the container holder of the system of FIG. 1.
Figure 7:
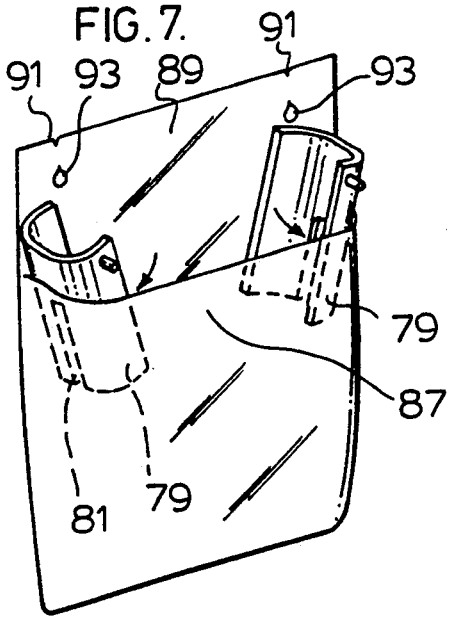
FIG. 7 is a further perspective view of the bag shown in FIG. 6 as it is being opened to receive product from the system.
Figure 8:
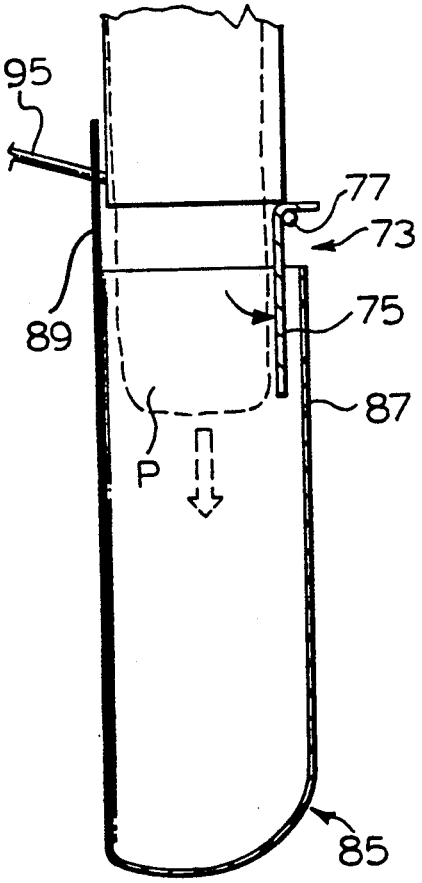
FIG. 8 is a side view of the bag of FIG. 7 showing product being loaded into the bag.
Figure 12:
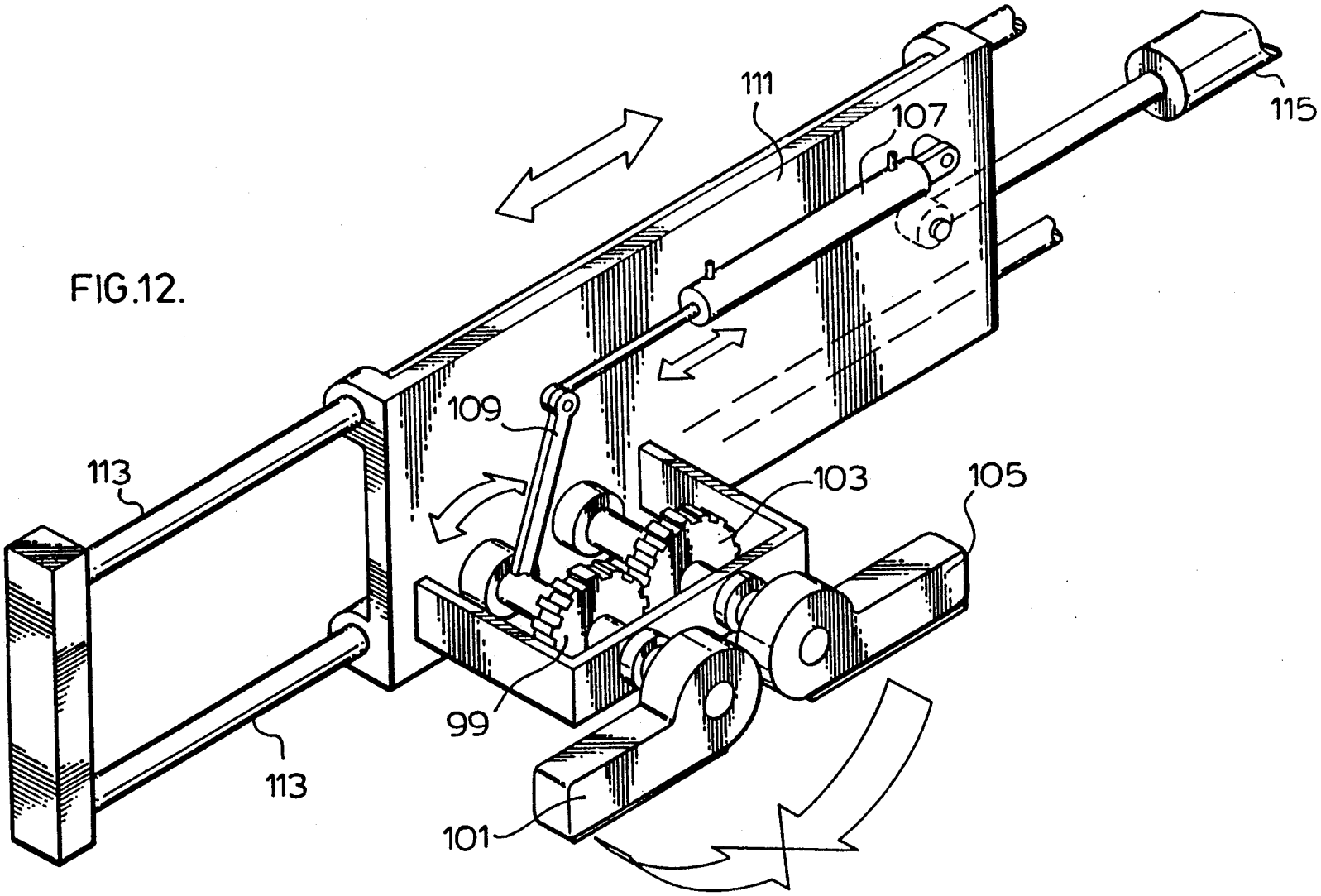
FIG. 12 is a enlarged perspective view of the bag gripper of FIGS. 10 and 11.

Provided at the bottom end of lower hopper 71 is a further trap door 75 that holds the product in the hopper until a bag, generally indicated at 85, has been moved to an open product receiving position beneath the hopper. As best seen in FIGS. 6 and 7 of the drawings, bag 85 includes a shorter front panel 87 and a taller rear panel 89. The rear panel is provided with openings 93 which are slid onto bag holding wicket pins 95. It is important that the bag be positioned as shown in FIG. 5 so that it is able to open forwardly beneath the hopper. The initial opening of the bag is achieved by means of an air jet 83 which blows down into and billows the bag open as seen in FIG. 6. From here a pair of pivotally mounted product guides and bag openers 79 move from an up position, as shown in solid lines in FIG. 5, to a down position, as shown in dotted lines in FIG. 5 and as also shown in FIG. 7. The product guide and bag openers 79 then complete the opening of the bag at which point a trap door 75, which is not found in my earlier bag holder, drops downwardly allowing the product P to drop down into the bag as shown in FIG. 8. At this point, the bag is supported from below and moved by means of a take-away conveyor 117. The bag also remains secured at its taller rear panel to the wicket pins 95 so that the bag remains in an upright position as seen in FIG. 8 and in a position to be dragged from the bag holder along the conveyor 117 by a bag gripper generally indicated at 97 in FIGS. 10 through 12.

The bag gripper, rather than lifting, simply assists in movement of the bag to a closure applying device generally indicated at 119 of the drawings. This closure device preferably applies a KWIK LOK TM which is a plastic releasable bag closure which is known in the industry and which does not form part of the present invention.

Figure 9:
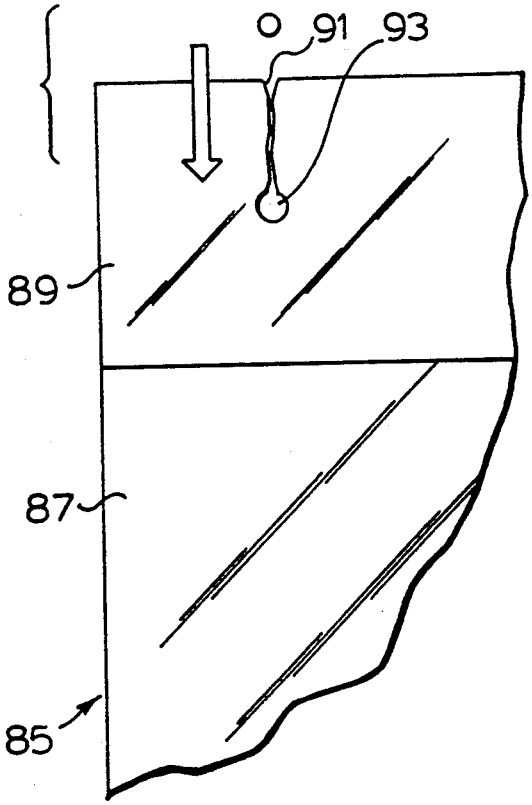
FIG. 9 is a enlarged front view of the upper corner region of the bag of FIGS. 6 through 8.

The gripper itself comprises a pair of geared members 99 and 103. Geared member 99 includes finger 101 while geared member 103 includes finger 105. The fingers on the gear members move from an in line horizontal position, as shown in FIG. 10 where the innermost finger 101 passes through a side slot 81 in product guide and bag opener 79. At this point, finger 101 is located above and to the inside of the sidewall of bag 85. From here, a piston 107, having a crank arm 109, extends inwardly causing the gear members 99 and 103 to rotate in unison with one another such that the fingers 101 and 105 now point downwardly and grip to the inside and the outside of the sidewall of the bag 85 as shown in FIG. 11. The rotatable grippers and their piston are in turn mounted on a slide carriage 111 which, through the operation of a piston 115, slides along guide rods 113 to carry the upper end of the bag as the lower end of the bag is supported and carried by or to the conveyor 117. The bag is easily torn from the wicket pins as a result of the preweakening of the rear panel of the bag as indicated at 91 in FIGS. 6, 7, and 9 of the drawings.

It will now be seen from the description above how a product loading system uses side by side staggered conveyors to carry product to side by side product receptacles. A hopper or chute which has a fixed lower end further includes a moveable upper end to shift back and forth between the receptacles so that both receptacles feed out of time with another to a common bag holder. This allows a very fast loading of the bags, i.e. in the order of one hundred bags per minute or more, while only requiring a single bag holder and a single conveying system for taking the filled bags to a bag closure device.

Although various preferred embodiments of the present invention have been described herein in detail, it will be appreciated by those skilled in the art, that variations may be made thereto without departing from the spirit of the invention of the scope of the appended claims.

The embodiments of the invention in which an exclusive property or privilege is claimed are defined as follows:

1. A system for loading a plurality of products into a container, said system comprising a conveyor with first and second side by side conveyor delivery portions moving continuously and simultaneously with one another and feeding product in a first direction to a product receptacle region common to said first and second conveyor delivery portions, said product receptacle region comprising side by side first and second receptacles, each conveyor delivery portion being divided along its length into a series of individual product carriers with the individual product carriers of said first conveyor delivery portion being offset longitudinally of said conveyor relative to the individual product carriers of said second conveyor delivery portion such that said first and second conveyor delivery portions continuously feed the products at alternate times respectively to said first and second receptacles of said product receptacle region, a delivery chute beneath said product receptacle region and a container holder which holds a container below said delivery chute, said delivery chute having a lower end constantly directed at said container holder and having an upper end with means for moving the upper end in a second direction perpendicular to the first direction in which the product is fed to the first and second receptacles between first and second positions beneath and directing the product from the first and second receptacles to the container at said container holder, each of said receptacles having a base and means for moving the base between a product holding and product release position, the base on said first receptacle being in the product release position and the base on said second receptacle being in the product holding position when said upper end of said delivery chute is in said first position beneath said receptacle and the base on said second receptacle being in the product release position and the base on said first receptacle being in the product holding position when said upper end of said delivery chute is in said second position beneath said second receptacle.

2. A system as claimed in claim 1, wherein each receptacle comprises a set of in-line compartments and a plate with an opening slideable over and selectively covering and exposing the compartments in each receptacle, the plates over said first and second receptacles moving at alternate times relative to one another.

3. A system as claimed in claim 1 wherein said delivery portions of said conveyor comprise side by side delivery belts, each belt having upright dividers along the length thereof, the dividers on said first delivery belt being longitudinally offset along the conveyor from the dividers on said second delivery belt.

4. A system as claimed in claim 3 wherein the dividers on said second delivery belt are positioned midway between the dividers on said first delivery belt.

* * * * *